US006624788B2

(12) United States Patent
Boyle

(10) Patent No.: US 6,624,788 B2
(45) Date of Patent: Sep. 23, 2003

(54) ANTENNA ARRANGEMENT

(75) Inventor: Kevin R. Boyle, Horsham (GB)

(73) Assignee: Koninklijke Philips Electronisc N.V., Eindhoven (NL)

( * ) Notice: Subject to any disclaimer, the term of this patent is extended or adjusted under 35 U.S.C. 154(b) by 0 days.

(21) Appl. No.: 10/055,376

(22) Filed: Jan. 22, 2002

(65) Prior Publication Data

US 2002/0130816 A1 Sep. 19, 2002

(30) Foreign Application Priority Data

Jan. 23, 2001 (GB) ..... 0101667

(51) Int. Cl.[7] ..... H01Q 1/38

(52) U.S. Cl. ..... 343/702; 343/700 MS

(58) Field of Search ..... 343/700 MS, 702, 343/906, 846, 848, 725, 729, 843

(56) References Cited

U.S. PATENT DOCUMENTS 6,054,954 A * 4/2000 Eggleston et al. ... 343/700 MS
6,252,552 B1 * 6/2001 Tarvas et al. ..... 343/700 MS
6,498,586 B2 * 12/2002 Pankinaho ..... 343/700 MS

FOREIGN PATENT DOCUMENTS

EP 1113524 A2 7/2001 ..... H01Q/21/28
WO WO9933144 7/1999 ..... H01Q/9/04

OTHER PUBLICATIONS

Patent Abstracts of Japan; Publication No.: 04157908; Publication Date: May 29, 1992; Application Date: Oct. 22, 1990 Application No. 02285142; Int'l Cl. H01Q 13/08; Entitled: Plate Antenna.
Patent Abstracts of Japan; Publication No.: 08274535; Publication Date: Oct. 18, 1996; Application Date: Mar. 30, 1995; Application No.: 07073376; Int. Cl. H01Q 13/08; Entitled: Antenna for Miniaturized Radio Equipment.
Patent Abstracts of Japan; Publication No: 2001274619; Publication Date: Oct. 5, 2001; Application Date: 37–03–00; Application No.: 2000090737; Int. Cl. H01Q 13/08; Entitled: Inverted–F Antenna.

* cited by examiner

*Primary Examiner*—James Clinger
(74) *Attorney, Agent, or Firm*—Jack D. Slobod

(57) ABSTRACT

An antenna arrangement comprises a patch conductor (102) having a feed conductor (106) connected to a first point and a grounding conductor (108) connected between a second point and a ground plane (104). An example of such an arrangement is a conventional planar inverted-F antenna. A problem with such antennas is that their impedance is inductive, making them difficult to feed. The present invention incorporates a slot (702) in the patch conductor (102) between the first and second points, which enables the inductive component of the antenna's impedance to be substantially reduced. Suitable positioning of the slot (702) on the patch conductor (102) also enables an impedance transformation to be achieved. The antenna described above may have a substantially reduced volume compared with known planar antennas with minimal reduction in performance.

8 Claims, 10 Drawing Sheets

ANTENNA ARRANGEMENT

FIELD OF THE INVENTION

The present invention relates to an antenna arrangement comprising a substantially planar patch conductor, feeding means connected to the conductor at a first point and grounding means connected to the conductor at a second point, and to a radio communications apparatus incorporating such an arrangement.

BACKGROUND OF THE INVENTION

Wireless terminals, such as mobile phone handsets, typically incorporate either an external antenna, such as a normal mode helix or meander line antenna, or an internal antenna, such as a Planar Inverted-F Antenna (PIFA) or similar.

Such antennas are small (relative to a wavelength) and therefore, owing to the fundamental limits of small antennas, narrowband. However, cellular radio communication systems typically have a fractional bandwidth of 10% or more. To achieve such a bandwidth from a PIFA for example requires a considerable volume, there being a direct relationship between the bandwidth of a patch antenna and its volume, but such a volume is not readily available with the current trends towards small handsets. Further, PIFAs become reactive at resonance as the patch height is increased, which is necessary to improve bandwidth.

SUMMARY OF THE INVENTION

An object of the present invention is to provide a planar antenna arrangement requiring a substantially smaller volume than known PIFAs and having improved impedance characteristics while providing similar performance.

According to a first aspect of the present invention there is provided an antenna arrangement comprising a substantially planar patch conductor, a feed conductor connected to the patch conductor at a first point and grounding conductor connected between a second point on the patch conductor and a ground plane, wherein the patch conductor incorporates a slot between the first and second points.

The presence of a slot affects the differential mode impedance of the antenna arrangement by increasing the length of the short circuit transmission line formed by the feeding and grounding means, thereby enabling the inductive component of the impedance of the arrangement to be significantly reduced. By a suitable asymmetric arrangement of the slot on the patch conductor, an impedance transformation can be achieved. This would typically be used to increase or decrease the resistive impedance of the arrangement for better matching to a 50 Ω circuit.

An antenna arrangement made in accordance with the present invention can have a substantially reduced separation between patch conductor and ground plane compared with known patch antennas. This enables a significant volume reduction, thereby enabling improved designs of mobile phone handsets and the like.

An antenna arrangement made in accordance with the present invention is also suited for being fed via broadbanding circuitry, for example a shunt LC resonant circuit.

According to a second aspect of the present invention there is provided a radio communications apparatus including an antenna arrangement made in accordance with the present invention.

The present invention is based upon the recognition, not present in the prior art, that the provision of a slot between feed and grounding pins in a PIFA can substantially reduce the inductive impedance of the antenna.

By means of the present invention PIFAs having improved performance and reduced volume are enabled.

BRIEF DESCRIPTION OF THE DRAWINGS

Embodiments of the present invention will now be described, by way of example, with reference to the accompanying drawings, wherein.

In the drawings the same reference numerals have been used to indicate corresponding features.

DETAILED DESCRIPTION OF THE PREFERRED EMBODIMENTS

Figure 1:
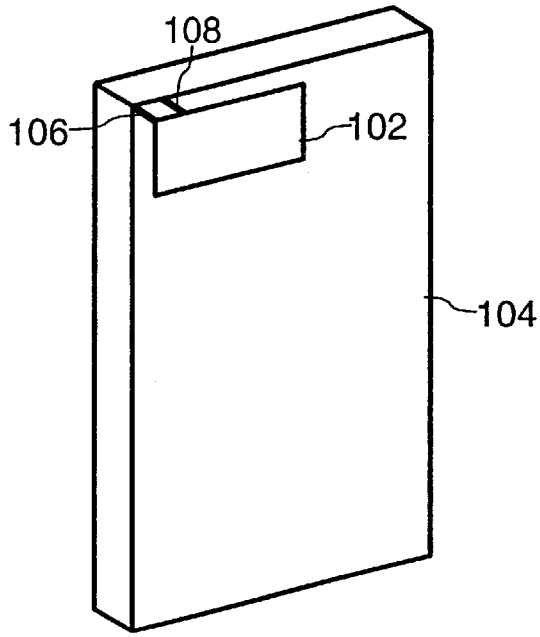
FIG. 1 is a perspective view of a PIFA mounted on a handset.

A perspective view of a PIFA mounted on a handset is shown in FIG. 1. The PIFA comprises a rectangular patch conductor 102 supported parallel to a ground plane 104 forming part of the handset. The antenna is fed via a feed pin 106, and connected to the ground plane 104 by a shorting pin 108.

Figure 2:
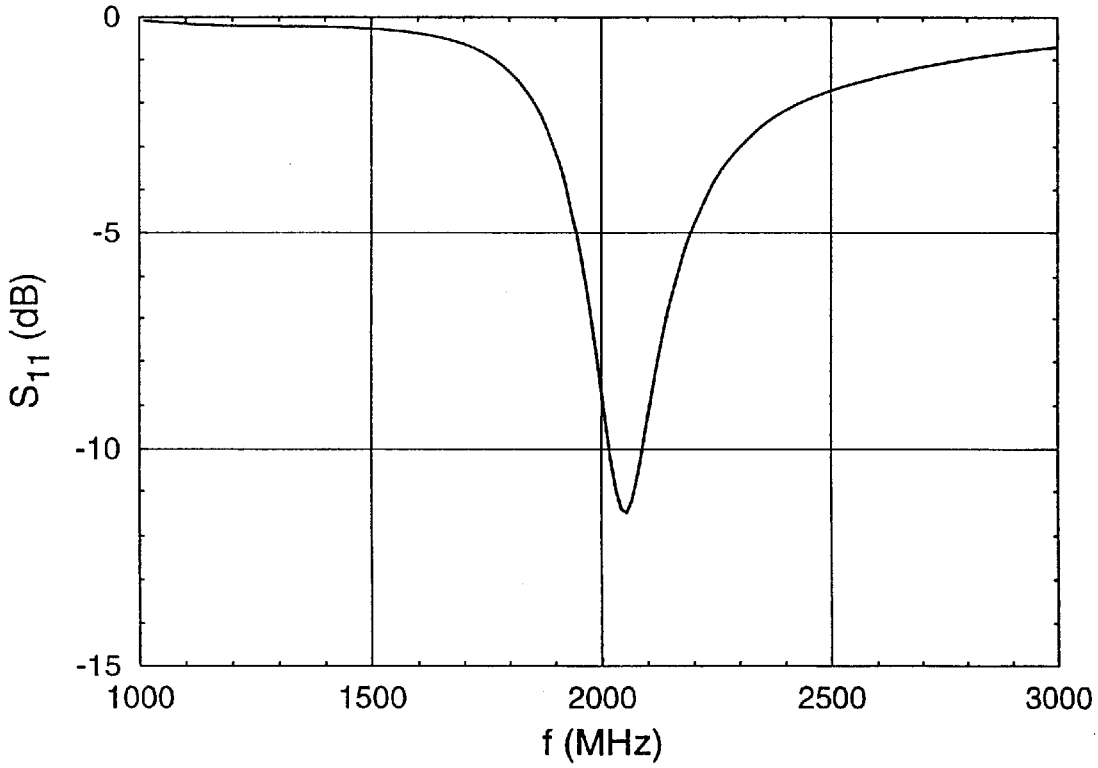
FIG. 2 is a graph of simulated return loss $S_{11}$ in dB against frequency f in MHz for the PIFA of FIG. 1.
Figure 3:
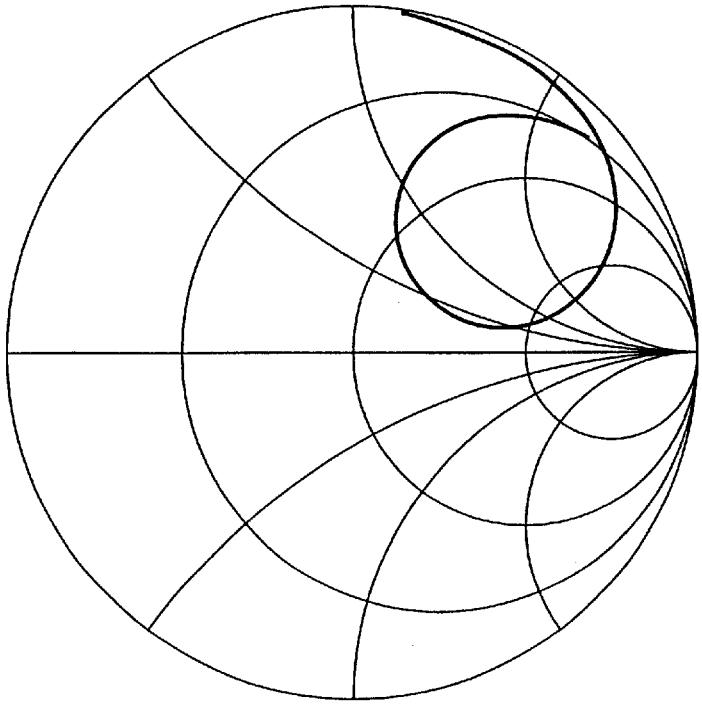
FIG. 3 is a Smith chart showing the simulated impedance of the PIFA of FIG. 1 over the frequency range 1000 to 3000 MHz.

In a typical example embodiment of a PIFA the patch conductor 102 has dimensions 20×10 mm and is located 8 mm above the ground plane 104 which measures 40×100×1 mm. The feed pin 106 is located at a corner of both the patch conductor 102 and ground plane 104, and the shorting pin 108 is separated from the feed pin 106 by 3 mm. The return loss $S_{11}$ of this embodiment (without matching) was simulated using the High Frequency Structure Simulator (HFSS), available from Ansoft Corporation, with the results shown in FIG. 2 for frequencies f between 1000 and 3000 MHz. A Smith chart illustrating the simulated impedance of this embodiment over the same frequency range is shown in FIG. 3.

It can clearly be seen that the response is inductive at resonance. The reasons for this can be seen be modelling the PIFA as a very small, heavily top-loaded folded monopole antenna. This model is illustrated at the left hand side of FIG. 4, with the patch conductor 102 forming a top load parallel to the ground plane 104, the feed pin 106, fed by a voltage source 402 supplying a voltage V, forming one arm of the folded monopole and the shorting pin 108 forming the other arm of the folded monopole.

Figure 4:
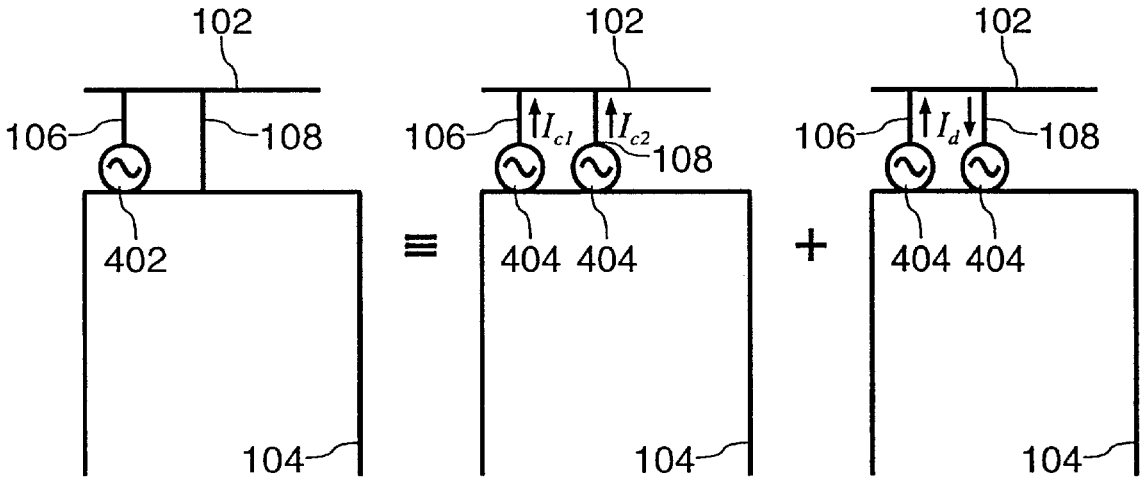
FIG. 4 shows a model of a PIFA as a top-loaded folded monopole formed from a combination of common mode and differential mode circuits.

When the feed and shorting pins 106, 108 are within a fraction of a wavelength of one another, the antenna can be decomposed, as shown in FIG. 4, into common mode (radiating) and a differential mode (non-radiating) parts. In the common mode part both the feed pin 106 and the shorting pin 108 are fed by a voltage source 404 providing a voltage of V12, thereby generating respective currents $I_{c1}$ and $I_{c2}$ in the pins 106, 108. The differential mode part is similar, but the voltage source 404 feeding the shorting pin 108 provides a voltage of −V/2, thereby generating nominally equal but oppositely-directed currents $I_d$ in each of the pins 106, 108.

The impedance of the common mode, $Z_c$, is given approximately as $$Z_c = Z_m + Z_h$$

where $Z_m$ and $Z_h$ are respectively the impedances of the monopole and handset over a perfectly conducting ground plane. The monopole comprises two closely coupled conductors (the feed and shorting pins 106, 108), and therefore has an increased diameter (and wider bandwidth). The impedance $Z_c$ is related to the currents and voltages by $$Z_c = \frac{V/2}{I_{c1} + I_{c2}}$$

If the pins 106, 108 are of equal diameter the currents $I_{c1}$ and $I_{c2}$ will both be equal and can be denoted by $I_c$, where $$I_c = \frac{V}{4Z_c}$$

Hence, the current is approximately a quarter of the current that would be supplied to a monopole of the same length.

The impedance of the differential mode, $Z_d$, is given by $$Z_d = jZ_0 \tan(\beta x)$$

which is the well-known impedance of a short-circuit transmission line. The differential mode current is given by $$I_d = \frac{V}{Z_d} = \frac{V}{jZ_0 \tan(\beta x)}$$

The total input current I is the sum of $I_c$ and $I_d$, which is $$I = \frac{V}{4Z_c} + \frac{V}{jZ_0 \tan(\beta x)}$$

Hence, the effective impedance of the structure is $4Z_c$ in parallel with $Z_d$. The impedance of the monopole and handset is transformed to a higher value by the action of the fold in the (radiating) common mode, which allows the low resistance of a short monopole to be transformed up to 50 Ω, but with an accompanying increase in the capacitive reactance. This reactance can then be tuned out by the effect of the differential mode impedance, a short circuit stub having a length of less than a quarter wave being inductive.

As shown in FIG. 4 the pins 106, 108 are of equal diameter. However, it can be advantageous to use pins of different diameter (or of different cross-sectional area for pins having a non-circular cross-section) as this can provide an impedance transformation. For example, if the cross-sectional area of the feed pin 106 is reduced and that of the shorting pin 108 is increased, then $I_{c1}$ is decreased and $I_{c2}$ is increased. Hence, for the same total current, the current supplied to the feed pin 106 is reduced thereby increasing the impedance of the antenna. By varying the ratio of cross-sectional areas of the pins 106, 108 a range of impedances can be achieved. A similar effect can also be achieved by replacing one or both of the pins 106, 108 by a plurality of conductors of identical size, with each of the pins 106, 108 being replaced by a different number of conductors, or by some combination of the two approaches.

Figure 5:
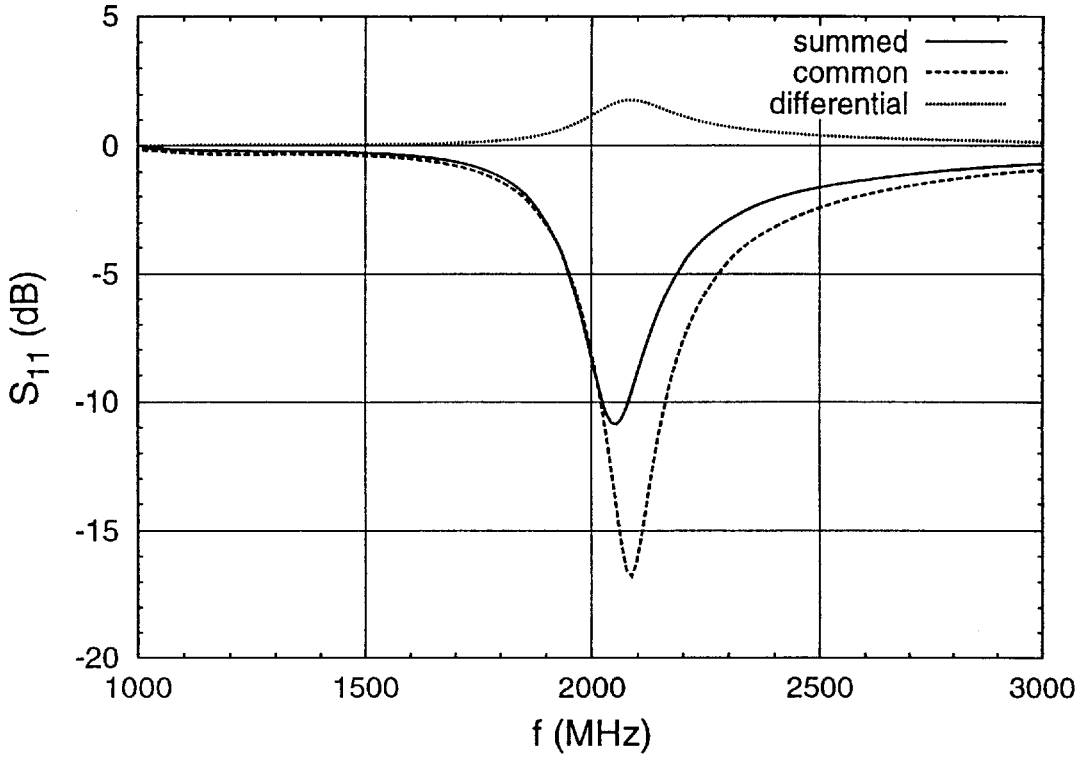
FIG. 5 is a graph of return loss $S_{11}$ in dB against frequency f in MHz for the PIFA of FIG. 2 simulated as a summation (solid line) of common mode (dashed line) and differential mode (dotted line) circuits.
Figure 6:
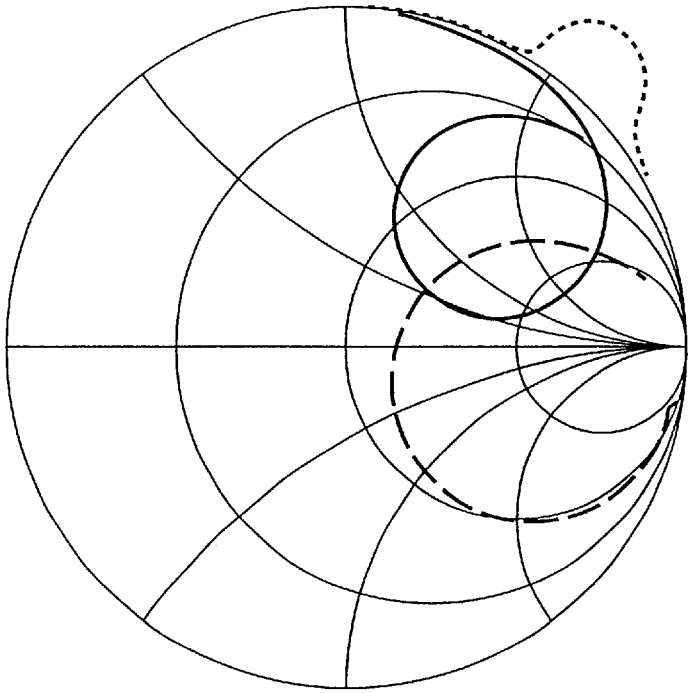
FIG. 6 is a Smith chart showing the impedance of the PIFA of FIG. 2 simulated as a summation (solid line) of common mode (dashed line) and differential mode (dotted line) circuits.

Simulations were performed driving the feed and shorting pins 106, 108 (of equal diameter) in common and differential mode. FIG. 5 shows the simulated return loss $S_{11}$ for frequencies f between 1000 and 3000 MHz and FIG. 6 is a Smith chart showing the simulated impedance over the same frequency range. In both figures the summed simulation results are shown by solid lines, while results for the common and differential modes are shown by dashed and dotted lines respectively. The differential mode response has been clipped since it displays a negative resistance at resonance, which is outside the bounds of a normal Smith chart. It is clear, from comparison with FIGS. 2 and 3, that the summation of the two modes gives results very similar to the original simulation, thereby demonstrating the validity of the approach.

Figure 7:
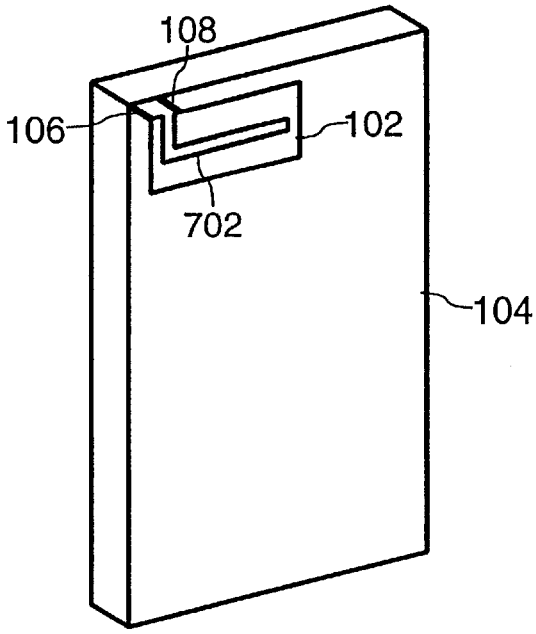
FIG. 7 is a perspective view of a slotted PIFA mounted on a handset.

It is also clear from FIG. 6 that the inductive response is caused by the shunt inductance of a short circuit transmission line formed between the feed pin 106 and shorting pin 108. This inductance can be removed by providing a longer transmission line. FIG. 7 is a perspective view of PIFA mounted on a handset, which has been modified from that of FIG. 1 by the introduction of a slot 702 into the patch conductor 102, thereby increasing the length of the transmission line. By positioning the slot centrally in the patch conductor 102 the four-times impedance transformation, provided by the folded monopole configuration, is maintained.

Figure 8:
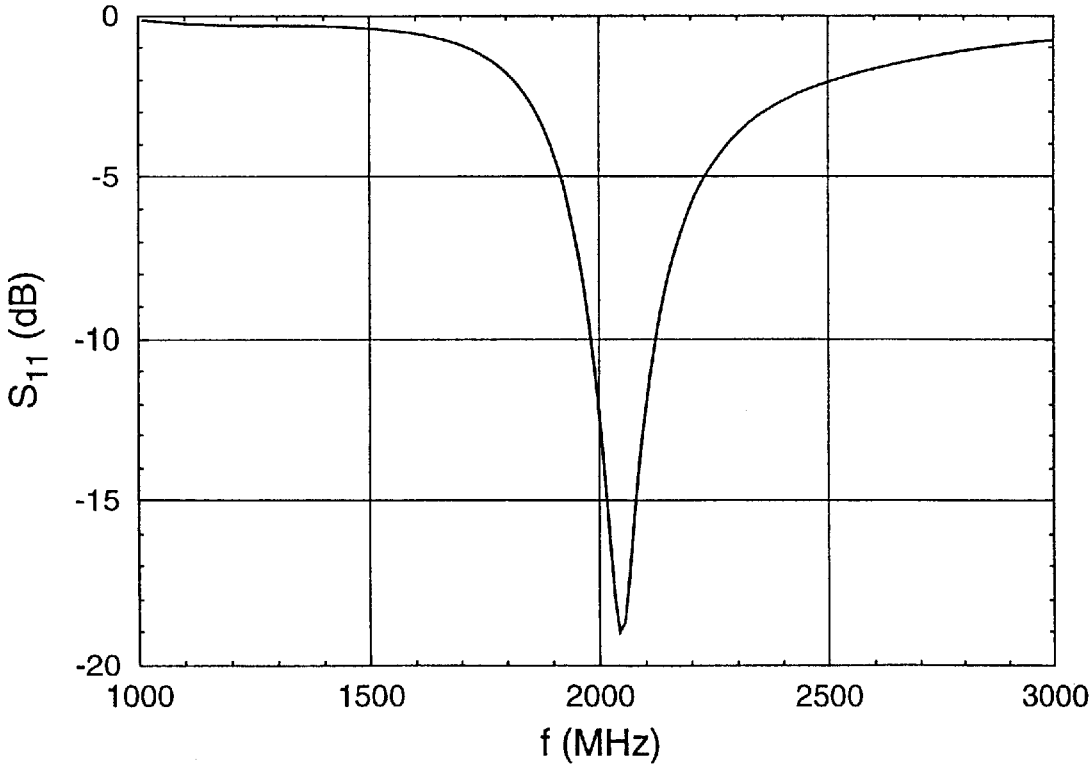
FIG. 8 is a graph of simulated return loss $S_{11}$ in dB against frequency f in MHz for the slotted PIFA of FIG. 7.
Figure 9:
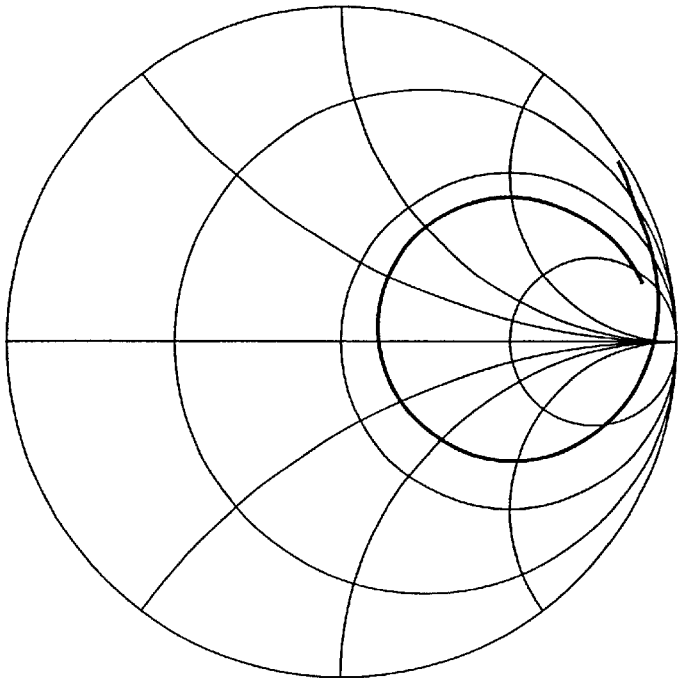
FIG. 9 is a Smith chart showing the simulated impedance of the slotted PIFA of FIG. 7 over the frequency range 1000 to 3000 MHz.
Figure 10:
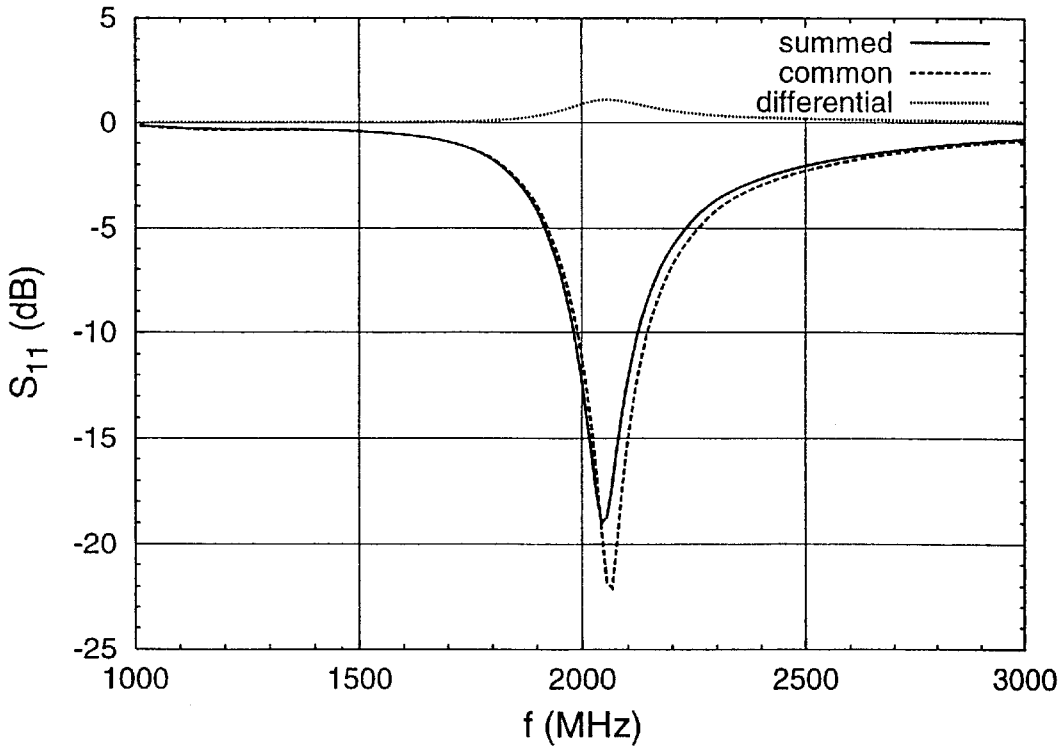
FIG. 10 is a graph of return loss $S_{11}$ in dB against frequency f in MHz for the slotted PIFA of FIG. 7 simulated as a summation (solid line) of common mode (dashed line) and differential mode (dotted line) circuits.
Figure 11:
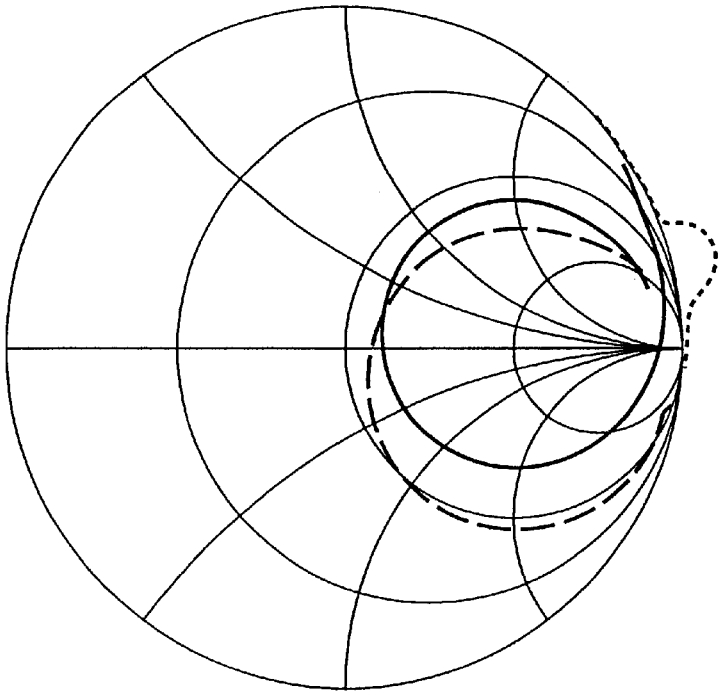
FIG. 11 is a Smith chart showing the impedance of the slotted PIFA of FIG. 7 simulated as a summation (solid line) of common mode (dashed line) and differential mode (dotted line) circuits.

Simulations of the performance of the PIFA shown in FIG. 7 were performed, with results for return loss $S_{11}$ shown in FIG. 8 and a Smith chart shown in FIG. 9. Simulations were also performed by common and differential mode analyses, as before, with results for return loss $S_{11}$ shown in FIG. 10 and a Smith chart shown in FIG. 11 (with the differential mode results clipped as in FIG. 6). Again, it is apparent that the common and differential mode analyses are appropriate. It is also clear from the Smith charts that the effect of the shunt reactance of the differential mode is greatly reduced by the incorporation of the slot 702. It can be seen that a longer slot would be optimal, which could be achieved by meandering the slot on the patch conductor 102.

The shapes of the $S_{11}$ response shown in FIGS. 8 and 9 (or 10 and 11) are clearly amenable to broadbanding using a conventional parallel LC resonant circuit connected in shunt with the antenna input. A series LC circuit connected in series with the input could also then be used. Alternatively, the length of the slot 702 could be arranged to be a quarter wavelength, thereby enabling the differential mode transmission line to be used for broadbanding purposes. A further advantage of this arrangement is that a quarter wavelength transmission line provides a high impedance, and therefore carries less current than the short, two pin transmission line of a known PIFA (which is low impedance), improving the efficiency of the antenna.

Figure 12:
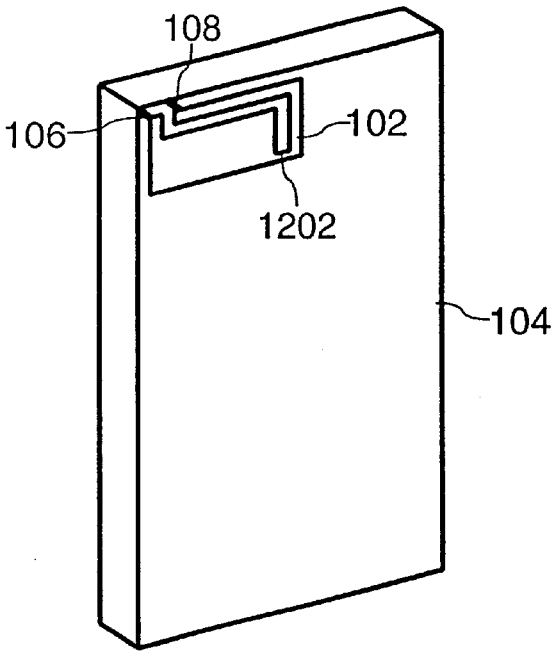
FIG. 12 is a perspective view of a slotted PIFA having reduced height mounted on a handset.

It is clear from the common mode analysis, and from the fact that the resistance at resonance is too high, that the antenna could be made to be lower profile. FIG. 12 is a perspective view of slotted PIFA mounted on a handset, which has been modified from that of FIG. 7 by reducing the separation of the patch conductor 102 and ground plane 104 from 8 mm to 2 mm. The slot 702 has also been moved closer to the edge of the patch conductor, thereby providing a significantly increased common mode impedance transformation.

Figure 13:
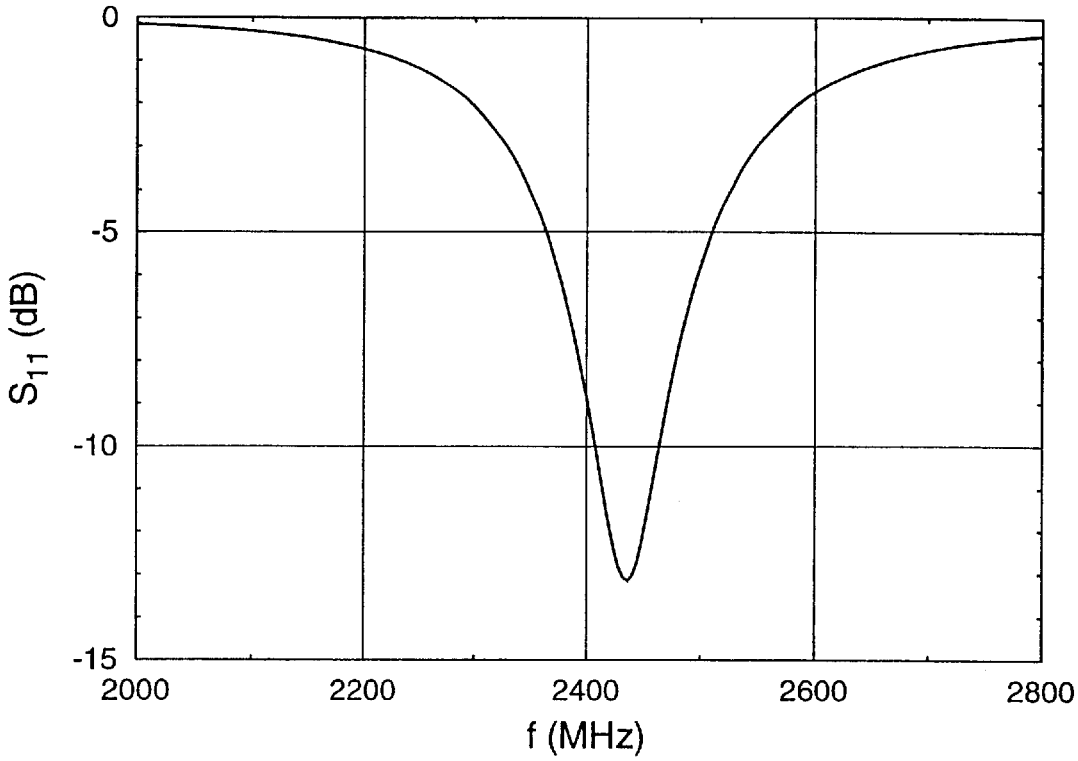
FIG. 13 is a graph of simulated return loss $S_{11}$ in dB against frequency f in MHz for the slotted PIFA of FIG. 12.
Figure 14:
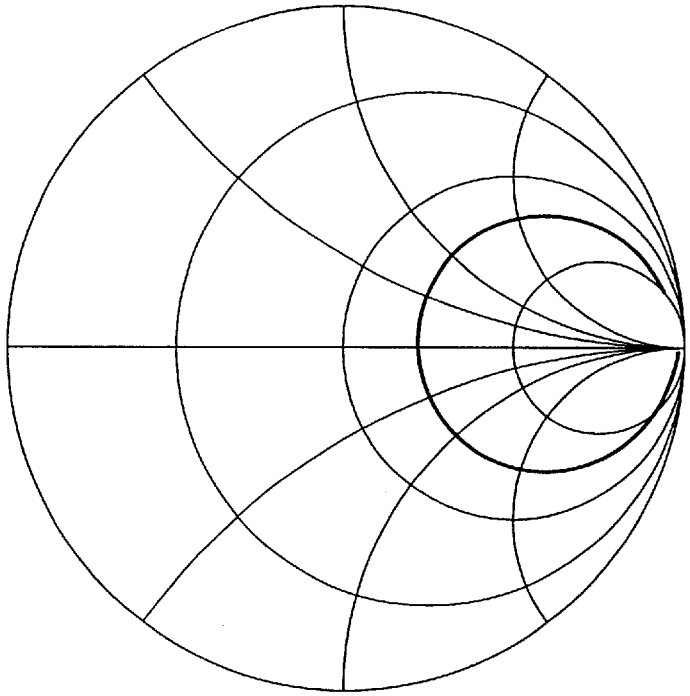
FIG. 14 is a Smith chart showing the simulated impedance of the slotted PIFA of FIG. 12 over the frequency range 2000 to 2800 MHz.

Simulations of the performance of the PIFA shown in FIG. 12 were performed, with results for return loss $S_{11}$ shown in FIG. 13 and a Smith chart shown in FIG. 14. The simulations demonstrate that a wide bandwidth is maintained despite the reduction in antenna volume. It is clear that further reductions in conductor separation (and therefore antenna volume) are possible.

Figure 15:
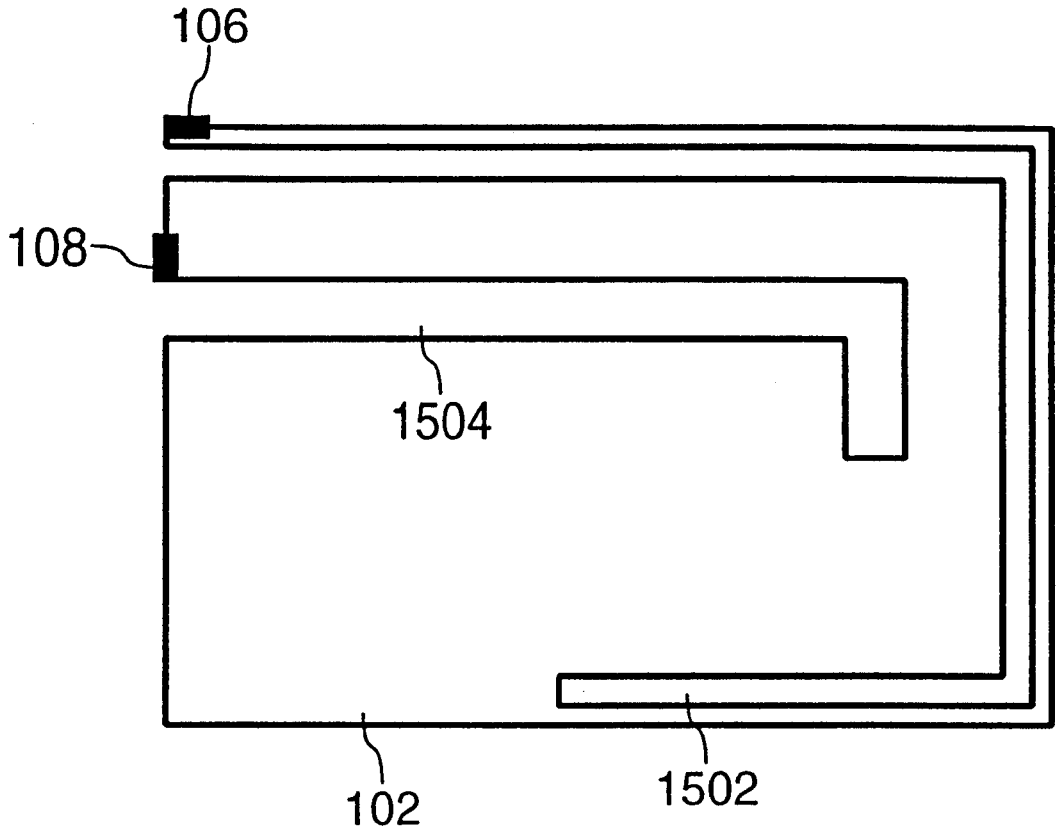
FIG. 15 is a plan view of a slotted PIFA suitable for a Bluetooth application.

FIG. 15 is a plan view of another slotted PIFA arrangement, suitable for a Bluetooth embodiment. The patch conductor 102 has dimensions 11.25×7.5 mm, is fed via a 0.5 mm-wide planar feed conductor 106 and grounded by a 0.5 mm-wide planar grounding conductor 108. A first slot 1502, located between the feed and ground conductors 106, 108, has a width of 0.375 mm and a length of approximately 25 mm (nearly a quarter of a wavelength). This slot acts to increase the length of the transmission line between the conductors 106, 108, as in previous embodiments. The slot 1502 is asymmetrically located in the patch 102, located just 0.25 mm from the edge of the patch, thereby providing a significant impedance transformation. A second slot 1504 is also provided in the patch conductor 102. This slot merely acts to increase the effective length of the patch 102.

Figure 16:
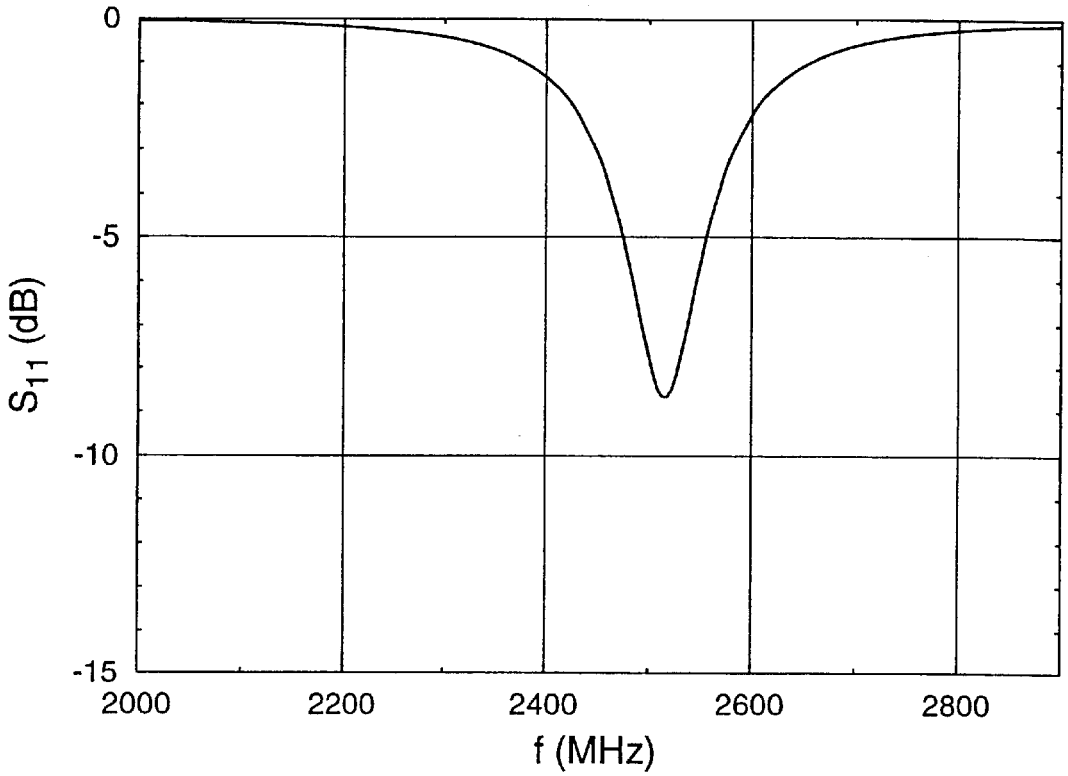
FIG. 16 is a graph of simulated return loss $S_{11}$ in dB against frequency f in MHz for the slotted PIFA of FIG. 15 with no matching network.
Figure 17:
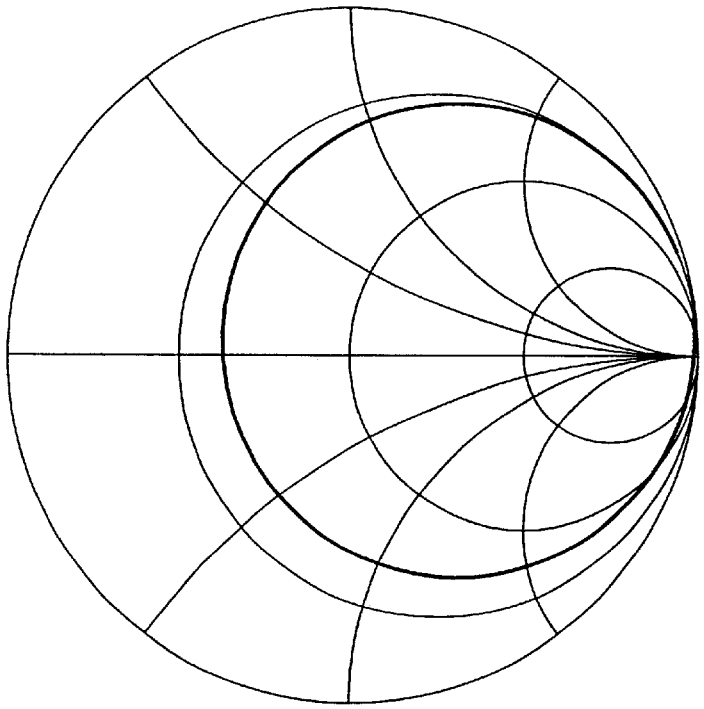
FIG. 17 is a Smith chart showing the simulated impedance of the slotted PIFA of FIG. 15 with no matching network over the frequency range 2000 to 2900 MHz.

Simulations were performed to predict the performance of the PIFA shown in FIG. 15 mounted 1 mm above the top left hand corner of a ground conductor having dimensions 100×40×1 mm (as in previous embodiments). Results for return loss $S_{11}$ are shown in FIG. 16 and a Smith chart is shown in FIG. 17. The simulations show that a reasonable bandwidth is achieved, the Smith chart demonstrating some potential for broadbanding.

Figure 18:
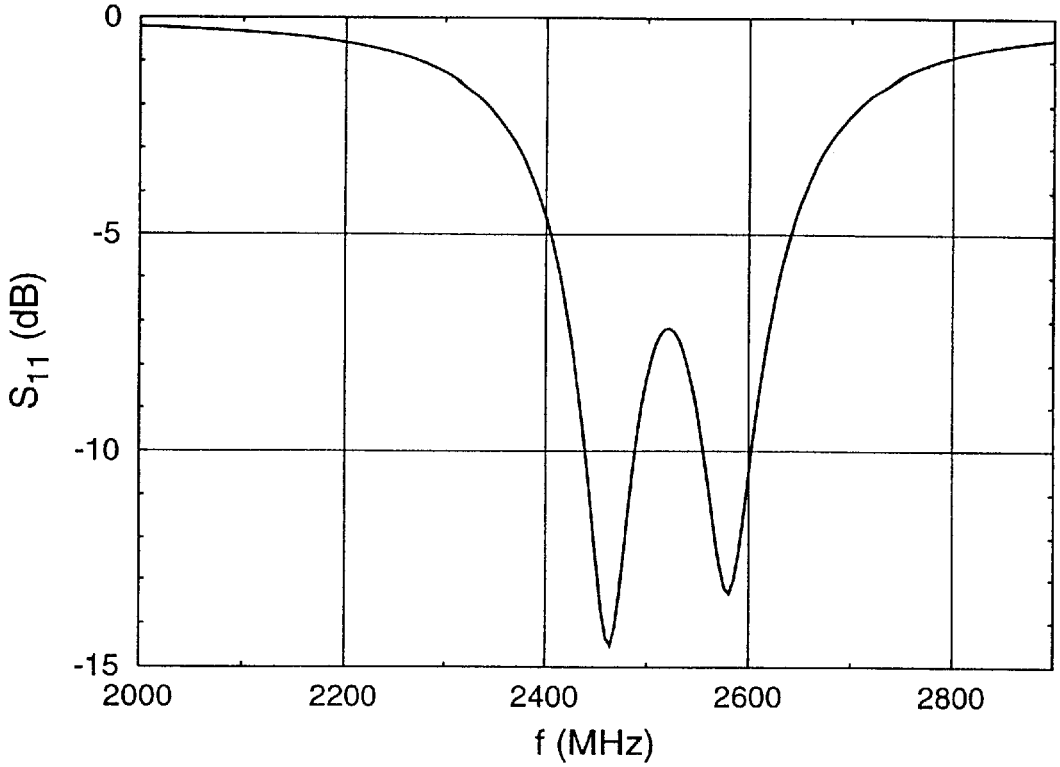
FIG. 18 is a graph of simulated return loss $S_{11}$ in dB against frequency f in MHz for the slotted PIFA of FIG. 15 with a shunt matching network.
Figure 19:
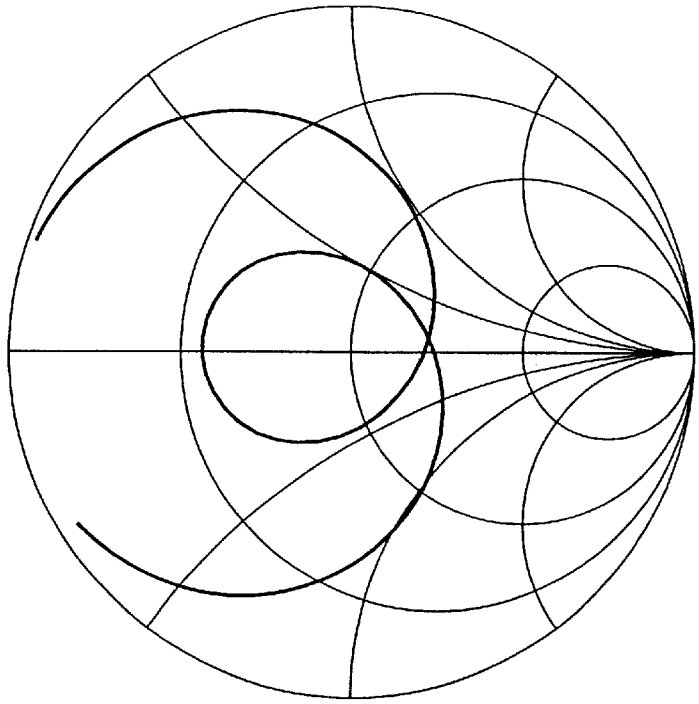
FIG. 19 is a Smith chart showing the simulated impedance of the slotted PIFA of FIG. 15 with a shunt matching network over the frequency range 2000 to 2900 MHz.

Further simulations of this PIFA were performed with the addition of a shunt matching network comprising a 0.25 nH inductor and a 16 pF capacitor in parallel. Results for return loss $S_{11}$ are shown in FIG. 18 and a Smith chart is shown in FIG. 19. It is clear that the matching has significantly improved both the match and bandwidth of the antenna, and there is the potential for further improvements by the addition of a series resonant circuit.

The results of the PIFA of FIG. 15 are particularly impressive taking into account its volume, which is significantly smaller than prior art antennas of equivalent performance. The dimensions are small enough for potential integration with Bluetooth modules, providing significant advantages in miniaturisation.

From reading the present disclosure, other modifications will be apparent to persons skilled in the art. Such modifications may involve other features which are already known in the design, manufacture and use of antenna arrangements and component parts thereof, and which may be used instead of or in addition to features already described herein.

In the present specification and claims the word "a" or "an" preceding an element does not exclude the presence of a plurality of such elements. Further, the word "comprising" does not exclude the presence of other elements or steps than those listed.

What is claimed is:

1. An antenna arrangement comprising a substantially planar patch conductor, a feed conductor connected to the patch conductor at a first point and grounding conductor connected between a second point on the patch conductor and a ground plane, wherein the patch conductor incorporates a slot between the first and second points, wherein the surface area of the grounding connector is at least twice the surface area of the patch conductor and wherein the patch conductor forms a top load with respect to the grounding conductor.

2. An arrangement as claimed in claim 1, characterised in that the ground plane is spaced from, and co-extensive with, the patch conductor.

3. An arrangement as claimed in claim 1, characterised in that the slot is positioned asymmetrically in the patch conductor, thereby providing an impedance transformation.

4. An arrangement as claimed in claim 1, characterised in that the slot has a length of substantially a quarter of a wavelength at a resonant frequency of the arrangement.

5. An arrangement as claimed in claim 1, characterised in that broadbanding means are coupled to the feed conductor.

6. An arrangement as claimed in claim 5, characterised in that the broadbanding means comprises a parallel resonant circuit connected between the feed conductor and ground.

7. An arrangement as claimed in claim 6, characterised in that the broadbanding means further comprises a resonant circuit connected in series with the feed conductor.

8. A radio communications apparatus including an antenna arrangement as claimed in claim 1.

* * * * *